United States Patent [19]

Birke et al.

[11] 4,173,077

[45] Nov. 6, 1979

[54] PROCESS AND ADDITIONAL DEVICES OF DRYING MACHINES FOR THE UNIFORM DRYING OF TEXTILES

[75] Inventors: Walter Birke; Hans-Ulrich von der Eltz; Franz Schon, all of Frankfurt am Main, Fed. Rep. of Germany

[73] Assignee: Hoechst Aktiengesellschaft, Frankfurt am Main, Fed. Rep. of Germany

[21] Appl. No.: 722,156

[22] Filed: Sep. 10, 1976

[30] Foreign Application Priority Data

Sep. 13, 1975 [DE] Fed. Rep. of Germany ..... 2540852

[51] Int. Cl.[2] ..... F26B 3/04

[52] U.S. Cl. ..... 34/23; 34/34; 34/229; 68/5 B; 68/20; 34/222

[58] Field of Search ..... 34/23, 34, 155, 159, 34/229, 222; 239/186; 8/149.2; 219/388, 348, 469–471; 68/5 B, 5 D, 6, 20

[56] References Cited

U.S. PATENT DOCUMENTS

| | | | |
|---|---|---|---|
| 1,470,306 | 10/1923 | Walsh | 34/159 |
| 1,829,139 | 10/1931 | Henderson | 34/222 |
| 2,016,125 | 10/1935 | Snow | 34/229 |
| 2,241,222 | 5/1941 | Sonnino | 68/5 B |
| 3,592,387 | 7/1971 | Pilott et al. | 239/186 |
| 3,736,669 | 6/1973 | Amidon, Jr. et al. | 34/229 |
| 3,739,605 | 6/1973 | Baker | 68/20 |

FOREIGN PATENT DOCUMENTS

| | | | |
|---|---|---|---|
| 905819 | 9/1962 | United Kingdom | 34/229 |

*Primary Examiner*—John J. Camby
*Assistant Examiner*—Larry I. Schwartz
*Attorney, Agent, or Firm*—Curtis, Morris & Safford

[57] ABSTRACT

Process for the uniform drying of a travelling textile web impregnated with treating agents by contacting the textile web oscillatorily over its width with the hot air current or heat radiation supplied by the corresponding sources of heat and hitting the web unilaterally or bilaterally. Devices for carrying out this process are described.

3 Claims, 1 Drawing Figure

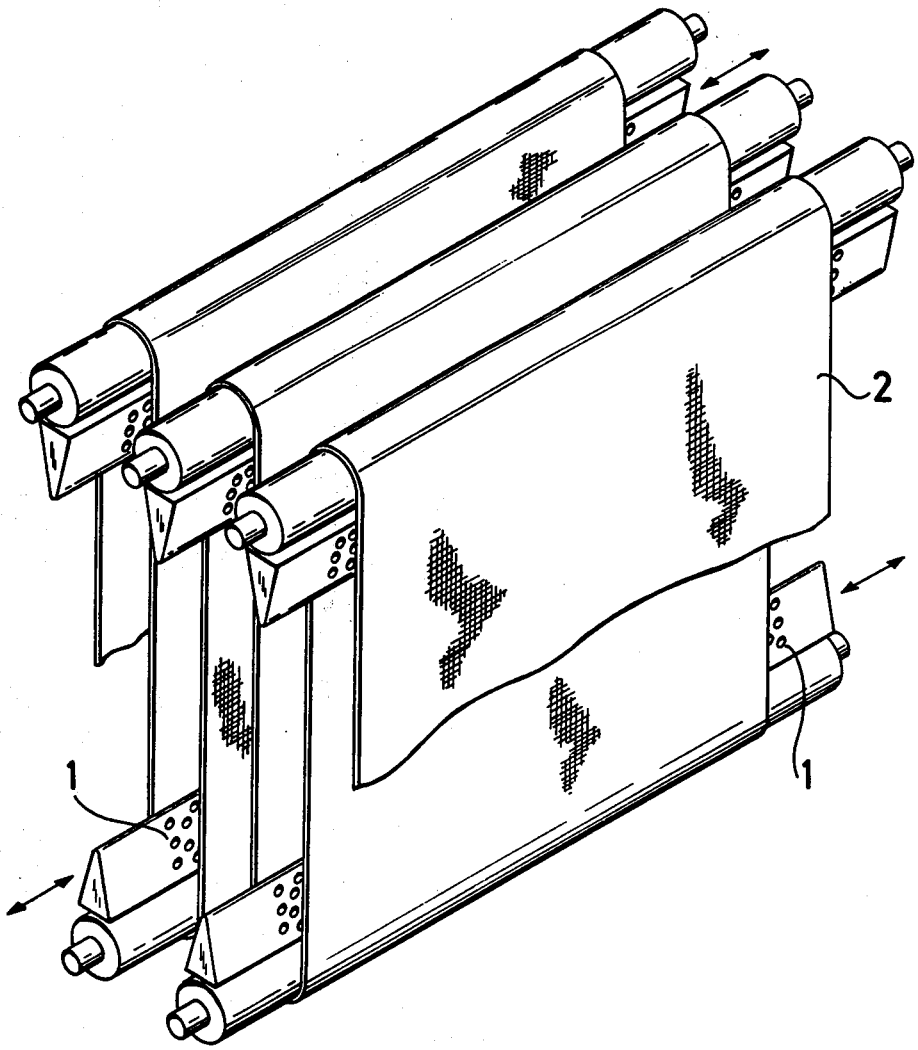
2
1
1

PROCESS AND ADDITIONAL DEVICES OF DRYING MACHINES FOR THE UNIFORM DRYING OF TEXTILES

Various processes for textile finishing, for example washing, bleaching, dyeing, optical brightening, dressing etc., include drying of the textile material. In this connection, known types of drying apparatus for continuous drying of textiles are for example cylinder dryers, tenters, hotflues or so-called pre-dryers in the form of electric IR radiators or gas radiators.

While in the case of cylinder dryers the textile material is heated, although only on one side, yet relatively uniformly over the whole width of the web because of the direct contact with the hot surface of the metal cylinders, this effect is not necessarily obtained in the case of drying apparatus operating according to other principles.

Especially in continuous finishing or dyeing processes of textile bidimensional structures, where a high degree of uniformity is required in the application of the products on the material and the subsequent drying, differences in evaporation of the impregnation liquor, caused for example in a hotflue or drying tenter by irregular blowing of hot air onto the textiles, or in radiation predryers by inhomogeneous heat transfer to the complete width of the material, may result in undesirable migration effects.

These migration effects become generally manifest in the form of so-called "color streaks", and they are due to the fact that, for example in a hotflue, the hot air current blown through the rigidly fixed slot- or hole-shaped nozzles over the width of the fabric constantly imparts to the web identical inherent irregularities which are predetermined by the nozzles. Similar effects are observed when other types of dryers are used, or in the case of predryers where the rigidly fixed IR radiators generate an inhomogeneous heat radiation over the width of the fabric.

It has now been found that better results are obtained in hot air or infrared drying of textile webs impregnated with dye-stuffs or finishing agents while maintaining the drying yield, i.e. that a substantially more uniform drying effect can be obtained, when the hot air current or heat radiation directed on the fabric is varied in its intensity regularly with respect to time but irregularly with respect to the width of the web, so that the difference of force of this air current or heat radiation are constantly shifted, i.e. the textile material is no longer hit locally at the same places along its width by the current or radiation varying in its intensity.

The subject of the present invention is a process for the uniform drying of a travelling textile web impregnated with treating agents by means of hot air discharged from nozzles and hitting the web unilaterally or bilaterally, or by means of heat radiation generated by infrared radiators, which comprises contacting the textile web oscillatorily over its width with the hot air current or heat radiation supplied by the corresponding sources of heat.

The present invention may be realized on the one hand in such a manner that the textile material to be dried is constantly moved to and fro at varied speed from one side to the other and transversally to its feed direction, i.e. that, while maintaining rigidly fixed air nozzles or IR radiators, practically all guide elements for the textile fabric within the drying apparatus must be mobile in the direction of the width of the web.

On the other hand, a better and more economic embodiment of the present invention provides for the hot air nozzles or heat radiators being mobile in a transverse direction to that of the feed of material, thus allowing the maintenance of fixed guide elements for the feed of the material as is the case in hitherto known plants usually employed in the industrial practice and thus preventing new problems from arising with respect to the proper feed of the web. This may be realized most simply by means of worm or eccentric gears which shift the nozzles etc. to and fro over the width of the fabric, optionally at varied speed. Coupling of these gears with the main drive of the drying plant is useful only in the case where a mechanical or electronic control system causes the two speeds to vary inversely, i.e. the nozzles etc. to move to and fro with increasing speed at decreasing feed of material.

In the case of rigidly fixed nozzles or IR radiators as well as material guide elements, a further mode of execution of the process in accordance with this invention provides for a constant shifting of the hot air current or heat radiation by means of mobile screens or reflectors arranged between the sources of heat and the textile fabric.

The present invention relates also to additional devices for textile drying machines of known design operating according to the principle of hot air blowing or heat radiation in order to carry out the cited process. Preferably, these devices provide hot air nozzles or heat radiators that are mobile in the direction of and over the width of the fabric and are driven by a worm or eccentric gear. According to a further type of device of this invention, the material guide elements are mobile with respect to the width of the web, and still another modification of the apparatus according to this invention provides screens or reflectors arranged over the width of the fabric between the hot air nozzles or heat radiators and the level of the travelling material.

The additional devices according to this invention are intended for use in drying tenters, hotflues, electric IR radiator or gas radiator dryers, for example. Especially in the case of a hotflue it is advantageous to see to it that the fixed or mobile hot air nozzles are positioned at the inner end of the corresponding textile loops instead of being situated at the beginning of these loops as is usual.

The accompanying drawing illustrates schematically apparatus adapted to be used in carrying out a preferred embodiment of the method of the invention.

Referring to the drawing, a conventional dryer is shown having a bank of rotating rolls comprising the upper tier of rolls 10 and lower tier of rolls 12. The running textile web 14 which is to be dried passes alternately over rolls 10 of the upper tier of rolls and rolls 12 of the lower tier rolls in a sinuous path. Located between adjacent folds of the web near each roll there is a heating unit 16 having openings or nozzles 18 through which hot air passes and impinges on the adjacent surface of the running web 14 to dry it. In the system illustrated the heating chambers 16 are reciprocated by mechanism not shown in a direction transverse to the direction of movement of the web 14, thereby improving the uniformity of the drying across the width of the web.

As indicated above, the relative movement of the heating units and web can be effected by moving the textile web laterally while maintaining the heaters 16 stationary. However, the oscillation of the heating chambers 16 is preferred since it involves fewer mechanical problems.

What is claimed is:

1. In a process for the uniform drying of a travelling moist textile material in the form of a structured fiber web impregnated with a fluid treating agent, containing a solid material that remains permanently in the web after drying, said process being of the type in which either one or both sides of the web are exposed to a heat source selected from a stream of hot air and radiant heat as the web passes over a bank of rotating rolls, the improvement which comprises applying the heat from said heat source to the moving web in a transversely oscillatory manner to improve the uniformity of drying across the width of the web.

2. A process according to claim 1 wherein the heat source is moved transversely in respect to the travelling web.

3. A process according to claim 1 wherein the travelling web is moved transversely in respect to the heat source.

* * * * *